United States Patent [19]

Kato et al.

[11] Patent Number: 4,614,164

[45] Date of Patent: Sep. 30, 1986

[54] AUTOMATIC PAINTING SYSTEM

[75] Inventors: Yoshito Kato; Shuichi Sunahara; Susumu Kurebayashi, all of Toyota, Japan

[73] Assignee: Toyota Jidosha Kabushiki Kaisha, Toyota, Japan

[21] Appl. No.: 682,101

[22] Filed: Dec. 17, 1984

[30] Foreign Application Priority Data

Jan. 30, 1984 [JP] Japan ..... 59-14850

[51] Int. Cl.[4] ..... B05B 15/06; B05B 15/08

[52] U.S. Cl. ..... 118/323; 118/326; 901/43

[58] Field of Search ..... 901/43; 118/323, 326; 98/115.2

[56] References Cited

U.S. PATENT DOCUMENTS

| | | | |
|---|---|---|---|
| 3,315,639 | 4/1967 | Close | 118/642 |
| 3,434,416 | 3/1969 | Testone | 101/416 |
| 3,500,741 | 3/1970 | Bok | 118/326 |
| 3,606,162 | 9/1971 | Lehmann | 239/227 |
| 3,874,595 | 4/1975 | Rindisbacher | 239/227 |
| 3,998,388 | 12/1976 | Alagna | 239/187 |
| 4,224,355 | 9/1980 | Lampkin et al. | 427/8 |
| 4,278,046 | 7/1981 | Clarke et al. | 118/695 |
| 4,323,030 | 4/1982 | Lehmann | 118/309 |

*Primary Examiner*—Shrive P. Beck

*Attorney, Agent, or Firm*—Oblon, Fisher, Spivak, McClelland & Maier

[57] ABSTRACT

An automatic painting system including a non-explosion-proof automatic painting machine which has an arm having a spray gun and an arm housing, the arm and the arm housing being inserted through an opening defined in a side wall of a closed painting booth into the interior of the painting booth. A hermetically sealing bellows is mounted on and extends between a distal end of the arm and an inner surface of the side wall around the opening therein for protecting a portion of the arm which is slidable with respect to the arm housing from the atmosphere in the painting booth. The interior of the bellows is kept in communication with the atmosphere through the opening in the side wall.

6 Claims, 2 Drawing Figures

AUTOMATIC PAINTING SYSTEM

BACKGROUND OF THE INVENTION

1. Field of the Invention

The present invention belongs to the field of automatic painting technology, and relates to an explosion-proof device in an automatic painting system.

2. Description of the Prior Art:

Conventional automatic painting systems have painting equipment and other devices placed in a closed painting booth. In operation, the operator is required to work in the painting booth for accomplishing the painting of objects. Accordingly, the various devices in the painting booth are required to be explosion-proof. In addition, the painting booth requires an air conditioning system such as an air curtain system for protecting the operator from paint mist in order to make the working environment safe.

Where the devices in the painting booth are robots, such may require multiple drive mechanisms or actuators as well as means for detecting operative positions. It has been found to be costly to render these actuators and detecting means explosion-proof. The actuator, for example, is required to consist of a hydraulic unit, and an electric control unit for the actuator is complex and large in size.

The inventor has filed U.S. patent application Ser. No. 628,287 on July 6, 1984 for an invention relating to an automatic painting system employing a robot driven by a DC motor. The disclosed invention is essentially concerned with an automatic painting system comprising a painting booth composed of a partition having a door for allowing transfer of a workpiece to be painted into and out of the painting booth and an air inlet port for supplying air into the painting booth to discharge paint mist out of the painting booth, and an electrically operated automatic painting robot comprising an arm having a spray gun, an arm housing accommodating said arm therein and extending through the partition, in a hermetically sealed relation thereto, into the painting booth, and a control unit connected to the arm and disposed outside the painting booth. This arrangement is successful to a certain extent in solving the foregoing problems with the painting system in which the painting devices are housed in the painting booth, that is, the problems of increased size of the overall system due to the large size of the explosion-proof device, associated increased costs, and the like.

However, it has turned out that the earlier invention has the drawback wherein, since the arm of the robot projecting into the painting booth is exposed to a paint mist, paint is deposited on a sliding portion of the arm, imparing the back-and-forth sliding movement of the arm with respect to the arm housing.

SUMMARY OF THE INVENTION

The present invention has been made in an effort to obviate the above shortcoming.

According to the present invention, a non-explosion-proof automatic painting machine has a body installed outside of a painting booth having a side wall with an opening defined therethrough. The automatic painting machine includes an arm housing inserted through the hole and an arm movable into and out of the arm housing. A hermetically sealing bellows is mounted on and between a non-sliding distal end of the arm and an inner surface of the side wall which extends around the opening for protecting a portion of the arm which is slidable with respect to the arm housing within the painting booth from the atmosphere in the painting booth.

It is an object of the present invention to provide an automatic painting system which is small in size, inexpensive, and can be operated with increased ease.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
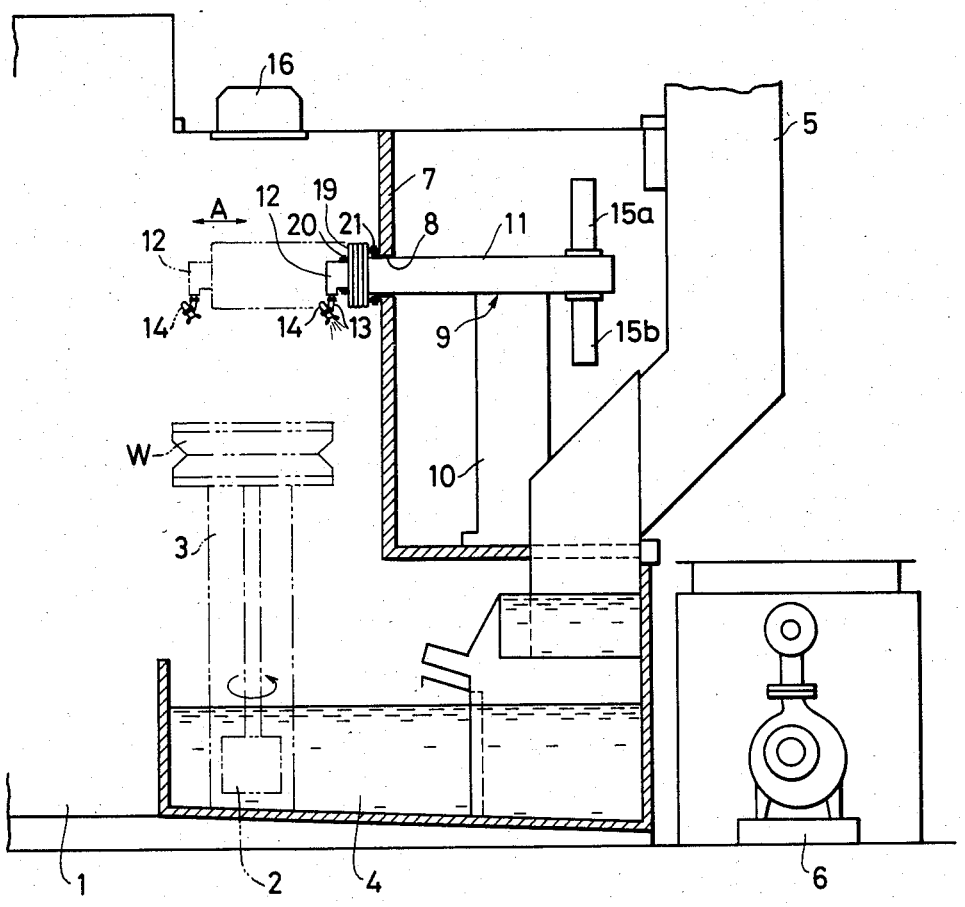
FIG. 1 is a side elevational view, partly in cross section, of an automatic painting system according to the present invention.

As shown in FIG. 1, an automatic painting system according to the present invention includes a closed painting booth 1, an actuator 2 for rotating a workpiece support 3, a water tank 4 mounted on the bottom of the painting booth 1, and a duct 5 disposed above the water tank 4 and extending upwardly out of the painting booth 1 for discharging paint mist. The water tank 4 and the duct 5 are employed to separate the paint mist from the air to be discharged by showering water from the duct 5 over the water tank 4.

The painting booth 1 has a side wall 7 having an opening on hole 8. An automatic painting machine 9 has a body 10 mounted outside of the opening 8. To the body 10 there is attached an arm housing 11 having one end projecting through the hole 8 into the painting booth 1. The arm housing 11 accommodates therein an arm 12 except for a distal end thereof, and the arm 12 is drivable by a drive source composed of actuators 15*a*, 15*b* for movement into and out of the arm housing through its outer end. A spray gun 14 is mounted by a wrist 13 on the distal end of the arm 12 and operable by the actuators 15*a*, 15*b*. An illuminating lamp 16 is mounted on the ceiling of the painting booth 1.

Figure 2:
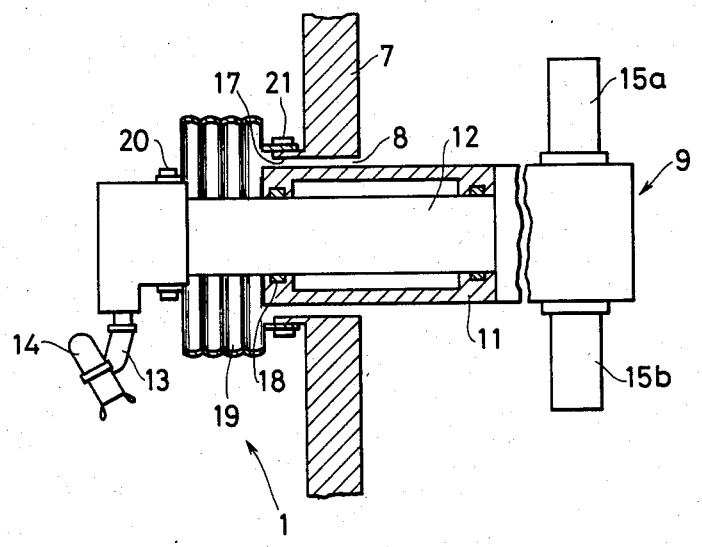
FIG. 2 is an enlarged side elevational view, partly in cross section, of an explosion-proof arrangement in the automatic painting system shown in FIG. 1.

As illustrated in FIG. 2, a clearance gap is defined between the outer wall of the arm housing 11 and the edge of the side wall 7 which defines the hole 8. An extensible and retractible bellows 19 is hermetically mounted by fastening bands 20, 21 on arm 12 and extends between the distal end of the arm 12 disposed in the painting booth 1 and a tubular flange 17 extending from an inner surface of the side wall 7 around the hole 8. The bellows 19 may be attached by adhesive bonding. The portion of the arm 12 which is slidable with respect to the arm housing 11 is therefore protected by the bellows 19 from the atmosphere in the painting booth 1, and is held in communication with the atmosphere through the gap between the edge of the hole 8 and the arm housing 11. Therefore, ambient air free from any paint mist can flow into and out of the bellows 19 as the arm 12 is extended and retracted. The bellows 19 should preferably be made of fire-retardant, corrosion-resistant vinyl chloride resin, for example. Seal rings 18 are disposed between the arm housing 11 and the arm 12.

With the arrangement of the invention, only the arm housing and the arm of the non-explosion-proof automatic painting apparatus project through the side of the painting booth into the interior thereof, and the bellows is hermetically mounted on and extends between the distal end of the arm and the side wall of the painting booth around the hole through which the arm and the arm housing extend. Therefore, the drive source such as motors or actuators and the body of the automatic painting apparatus including position detectors and the like can be installed outside of the painting booth, and the sliding portion of the arm with respect to the arm housing is protected from the atmosphere in the painting booth and kept in communication with the atmosphere. The arm can thus be operated with ease. The automatic painting system of the invention is small in size, low in cost, and can be operated easily.

Although a certain preferred embodiment has been shown and described, it should be understood that many changes and modifications may be made therein without departing from the scope of the appended claims.

What is claimed as new and desired to be secured by Letters Patent of the United States is:

1. An automatic painting system comprising:

a painting booth having a side wall with an opening formed therein;

a non-explosion-proof automatic painting machine disposed in an ambient atmosphere outside of said painting booth and having an arm housing positioned in said opening and which extends to a position located within said painting booth and a movable arm having a first portion housed within said arm housing and a second portion extended from said arm housing to a position within said painting booth;

a bellows open at one end and closed at an opposite end and mounted on and extending between a distal end of said movable arm and an inner surface of said side wall around said opening so as to be exposed via said open end of said bellows to said ambient atmosphere outside said painting booth for protecting a portion of said arm which is slidable with respect to said arm housing from an atmosphere in said painting booth and wherein an outer wall of said housing and an edge portion of said side wall form a clearance gap therebetween; and a spray gun connected to said movable arm at a position outside said bellows.

2. An automatic painting system according to claim 1, wherein said bellows further comprises a fire-retardant, corrosion-resistant, vinyl chloride, resinous bellows.

3. An automatic painting system according to claim 1, wherein said inner surface of said side wall is tubular in shape.

4. An automatic painting system according to claim 1, further comprising a plurality of fastening bands for mounting said bellows on said distal end of said movable arm and said inner surface of said side wall.

5. An automatic painting system according to claim 1, further comprising adhesive bonding means for mounting said bellows on said distal end of said movable arm and said inner surface of said side wall.

6. An automatic painting system according to claim 1, further comprising wrist means located outside said bellows for interconnecting said movable arm and said spray gun.

* * * * *